United States Patent [19]

Barthels et al.

[11] 4,134,535

[45] Jan. 16, 1979

[54] PRESSURE RELIEF VALVE FOR PACKING CONTAINERS

[75] Inventors: Manfred Barthels, Bremen; Peter Werkhoff, Varell; Otto Vitzthum, Bremen, all of Germany

[73] Assignee: HAG Aktiengesellschaft, Bremen, Germany

[21] Appl. No.: 876,949

[22] Filed: Feb. 10, 1978

Related U.S. Application Data

[63] Continuation-in-part of Ser. No. 800,735, May 26, 1977, abandoned.

[30] Foreign Application Priority Data

Jun. 4, 1976 [DE] Fed. Rep. of Germany ..... 2625350

[51] Int. Cl.[2] ..... B65D 31/14; F16K 9/00

[52] U.S. Cl. ..... 229/62.5; 137/251; 220/205; 220/374; 229/DIG. 14; 426/118

[58] Field of Search ..... 426/118; 229/62.5, DIG. 14; 137/251; 150/9; 55/524, 309, 310, 313; 220/367, 371–373, 205, 374

[56] References Cited

U.S. PATENT DOCUMENTS

| | | | |
|---|---|---|---|
| 2,361,344 | 10/1944 | Yates | 426/118 |
| 2,870,954 | 1/1959 | Kulesta | 426/118 |
| 3,088,255 | 5/1963 | Griem | 229/62.5 |
| 3,672,915 | 6/1972 | Wiggins | 426/118 |
| 3,799,427 | 3/1974 | Goglio | 229/62.5 |
| 4,000,846 | 1/1977 | Gilbert | 426/118 X |

FOREIGN PATENT DOCUMENTS

| | | | |
|---|---|---|---|
| 1169280 | 11/1969 | United Kingdom | 229/DIG. 14 |

*Primary Examiner*—Steven L. Weinstein
*Attorney, Agent, or Firm*—Watson, Leavenworth, Kelton & Taggart

[57] ABSTRACT

A pressure relief valve for packages in which the valve element comprises a liquid impregnated porous element covering outlet openings in the package, with the liquid layer in the porous element being torn open by package contents pressures in excess of a predetermined value to permit gas outflow from the package.

10 Claims, 3 Drawing Figures

PRESSURE RELIEF VALVE FOR PACKING CONTAINERS

CROSS RELATED APPLICATION

This application is a continuation-in-part of pending application Ser. No. 800,735 filed May 26, 1977, now abandoned.

BACKGROUND OF THE INVENTION

It is known that roasted coffee when packed in commercial packaging will generally retain its fresh aroma for only about 8 to 10 weeks. Then an aging process sets in, oxygen-catalyzed condensation and polymerization reactions taking place, possibly with the formation of peroxides in small quantities which impart a sensorially undesired note to the coffee aroma and taste.

Attempts have therefore been made in various ways to develop coffee packaging in which there remains no more than a minimum of oxygen, such packaging forms being, for example, hermetic vacuum hard packs, hermetic soft packs evacuated and subsequently filled with a shielding gas, vacuum cans, etc. While in the case of ground coffee improvements were achieved thereby, with coffee in whole bean form the problem of slow $CO_2$ regassing from the beans occurred. The reason is this: In the roasting process, besides the formation of the brown color and of the coffee aroma, much $CO_2$ is released, which for the most part is included in the roasted beans. This gas, which amounts to a multiple of the bean volume (Lit.: R. Radtke et al: Kaffee & Tea Markt 25 (17), 7–14 (1975)), diffuses out of whole beans slowly in preponderant degree during the first two or three weeks and causes an undesirable bloating of the hermetic packing. With ground coffee, this effect is practically no longer observable, as the $CO_2$ is much more rapidly released from the roasted coffee during the grinding process.

The attempt has been made, therefore, to solve the problem of the gradual $CO_2$ desorption in roasted beans by using vacuum cans which are designed to withstand an increased internal pressure, or by welding $CO_2$-adsorbing substances, packed in small polyethylene sacs, into the laminate foil which serves as packaging material, or by using a mechanical valve which opens at a certain $CO_2$ pressure and can be welded into a gas-proof package in known manner.

The operational safety of such pressure relief valves has been improved before by using in support of the valve effect, a liquid layer of high cohesive force as has been known for a long time, in greased ground valves. In an arrangement known from German laid-open application OS No. 2,360,126 (British patent specification No. 1,434,660 and U.S. Pat. No. 3,799,427 being counterparts thereof), a rubber disk serving as valve element lies on a valve seat which, like the rubber disk, is coated with a silicone oil film. The disk type valve body can lift off its valve seat only when the internal pressure present in the package has overcome the sum of the elastic reaction of the valve body and the adhesive force of the viscous intermediate layer between the valve body and valve seat. As small pressure forces are not sufficient to release the adhesive force of the viscous intermediate layer, the pressure relief valve opens only at certain excess pressure, so that the deflection of the valve element is relatively great and therefore a certain period of time passes before upon cessation of the excess pressure, the valve element has again approached the valve seat to the extent that, due to the viscous intermediate layers, joint action of the adhesive forces occurs again and thus complete tightness exists again, preventing any undesired access of gas, e.g., air.

Prior art pertinent to the present invention in addition to the above-mentioned German OS, includes U.S. Pat. Nos. 2,361,344; 2,870,954; 3,088,255; 3,672,915; 3,799,427 and 4,000,846, as well as British patent No. 1,169,280.

SUMMARY OF THE PRESENT INVENTION

The object underlying the present invention is to provide a pressure relief valve which responds to and operates at very small overpressures, thereby reducing the danger that during the interval between abatement of the overpressure and the renewed joint action of the viscous forces, a gas exchange such as air incursion occurs in an undesired direction, i.e., into the interior of the package or container.

This is achieved according to the invention in that the valve element consists of a porous element which is impregnated with a low-volatility liquid of high cohesivity or respectively of high surface tension and is fixed peripherally between the container wall and covering, and that the valve effect takes place solely by rupture of the liquid layer in the pores of the element.

As a result of this design, the pressure relief valve responds readily at low overpressure which overpressure would not be sufficient for the effective and proper mechanical actuation of a valve element coated with a viscous layer.

DESCRIPTION OF THE PREFERRED EMBODIMENTS

The invention will be explained below with reference to the drawings.

Figure 1:
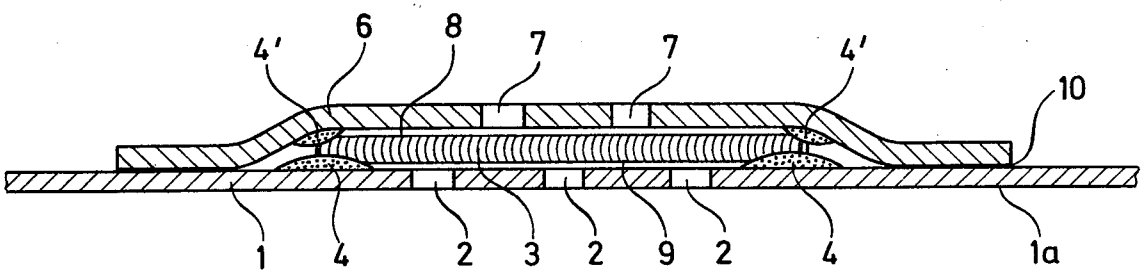
Figure 2:
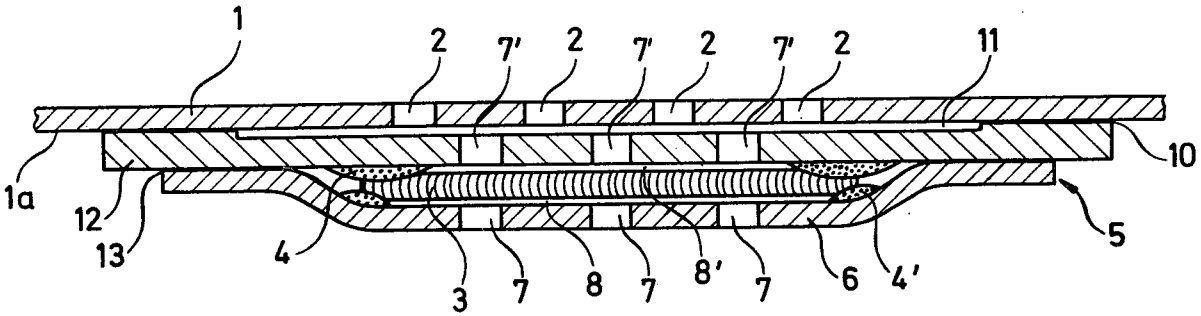
Figure 3:
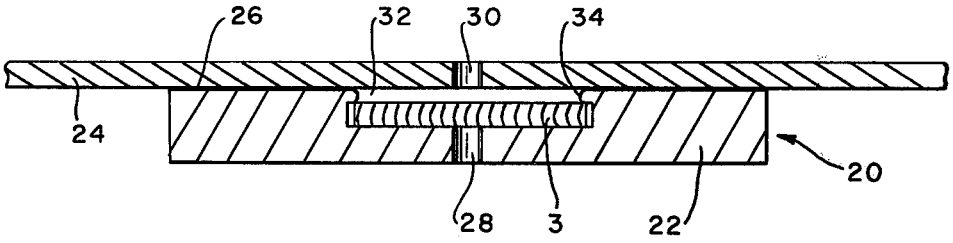

FIG. 1 shows a transverse section through a package or container to which the valve element is applied directly, FIG. 2 is a transverse section through a package or container with which the valve element is connected as an independent unit, and FIG. 3 is a transverse section through a package or container in which the valve element is press fitted into a molded covering element which in turn is connected to a wall of the package.

With reference to FIG. 1, the valve element 3 consists of a porous element which is impregnated with a liquid and is in peripherally fixed or sealed relationship with container wall 1 and there being an overlapping covering 6 consisting of a foil or a molding. This is effected for example by a peripheral adhesive layer or weld seam 4 situated between the valve element and container wall or by an adhesive layer or weld seam 4' between the valve element and covering 6. The surface layer 1*a* of the container wall preferably constitutes the inner face of the package or container, but may alternatively form the outer face. In the zone of the valve, the container wall 1 is provided with perforations 2, which have for example a diameter of about 1 mm, and the covering 6 has perforations 7. The valve element 3 may, if desired, be designed so that it is spaced a small distance as at 8 or 9 from the covering 6 or the container wall 1. At 10 the container wall 1 is heat-sealed or glued to the covering 6. The adhesive layers or weld seams 4 and 4' may be used simultaneously instead of alternatively.

Filter paper is especially suitable as valve element, but also elements of porous ceramic, such as sintered glass, pressed kieselguhr, sintered metal and plastic foam material may be used, likewise glass fiber mats, synthetic fabrics and air-permeable large-pored plastic leather.

It is especially advantageous if the valve element 3 which serves as a carrier for the liquid can be welded into the packing foil. This is possible for example with thick filter pper, and probably being able to be explained by the same sticking to a polyethylene material container.

As liquid for the impregnation of the valve element are suitable all liquids of great cohesive force or high surface tension, which have little volatility, are insensitive to oxygen, non-hygroscopic and chemically stable, have little solubility for $O_2$ and practically no odor of their own, as for example silicone oil, olive oil, peanut or bone oil, also mineral oils and certain plasticizers such as dioctyl, dinonyl, didecyl phthalates or sebacic acid esters. The viscosity should be approximately between 3 and 12 Engler degrees at 20 deg.C.

The overpressure at which the valve opens depends on the surface tension of the carrier liquid and the mean pore diameter of the carrier material according to the equation $p = 2\ gamma/R$, where gamma is the surface tension and R the mean pore diameter of the carrier material. By variation of the liquid as well as by alteration of the porosity of the carrier the opening pressure of the valve can be varied. At $CO_2$ overpressure in the interior of the packing container, the pressure relief valve responds at a certain pressure difference, the liquid in the pores "ruptures", the valve opens, and after pressure equalization the liquid layer in the pores is restored and blocks the passage of gas.

EXAMPLE

A filter paper having a weight of 350 $g/m^2$ and a filtration time according to the Herzberg testing system of 80 seconds is used, has a diameter of about 2 cm, a thickness of 0.9 mm and is impregnated with silicone oil of about 2000 cSt/20deg. The pressure relief valve opens at a pressure of 15 mbar and closes at about 10 mbar.

In the embodiment shown in FIG. 2, the pressure relief valve may be used as a separate valve arrangement 5 in which the valve element is enclosed at each of its two sides by a foil or molding. Such a valve arrangement 5 may be provided on the inside as well as on the outside of the package or container. In FIG. 2, the surface layer 1*a* constitutes preferably the inner face of the package or container provided with perforations 2. On its face toward the container wall 1, the valve arrangement 5 may be provided with a shallow recess 11 which facilitates the passage of the gases from the interior of the package or container to the atmosphere.

To facilitate the passage of gas, the valve element 3 may be at a small distance 8 or 8' from the covering 6 or the molding 12 and is hermetically connected with the molding or mounting strip 12 and/or the covering 6 by an adhesive or sealing connection 4 or 4'.

The covering 6 and molding 12 of the valve arrangement 5 are hermetically interconnected by a heat sealing 13, while the valve arrangement 5 as a whole is connected with the container wall by a sealing 10. Said sealings could alternatively be replaced by adhesive connections.

The covering 6 is provided with a number of perforations 7, and the molding 12, which as mentioned may consist alternatively of a foil, with a number of perforations 7', whereby the arrangement can operate in accordance with that of FIG. 1.

The pressure relief valve according to the invention is suitable especially for packages or containers into which coffee in whole bean form is filled immediately after roasting, although also other applications, for example for the packing of cheese, have advantages.

To test a package or container equipped with the pressure relief valve of the invention, coffee in whole bean form was packed immediately after roasting, the package or container was evacuated, and thereafter a regassing both with nitrogen and with carbon dioxide was effected. The packed product was subjected to a sensory test at intervals of 4 weeks for a period of 6 months. An equally fresh roasting aroma was always noted.

The function of the valve is explained by the capillary effect. Upon a certain overpressure being reached and by reason of the liquid having sufficiently high cohesivity or high surface tension and the porous element having sufficient pore size that the liquid layer is ruptured by the gas overpressure because the pressure forces are greater than the cohesive forces acting between the liquid particles. After pressure equalization, the capillaries formed in the liquid layer are closed again by the surface forces.

In the FIG. 3 embodiment, the valve arrangement 20 includes a shaped or molded, e.g., polyethylene component 22 which can be fixed to a container wall 24 as by adhesive or weld seam connection as at 26, the component 22 and container wall 24 having the respective gas-outlet passages 28, 30. Component 22 also is provided with a recessed cavity 32, the entry end of which is demarked by a radially inwardly directed flange 34 that extends in an encircling course. The valve element 3 received in such cavity by being press-fitted into same and locates below the flange 34 in tight engagement therewith so as to effect a sealed fixed relationship around the periphery thereof and with the container wall 24.

What is claimed is:

1. A package for holding contents which emit gas while contained in said package, said package comprising walls defining a container enclosure structure, one of said walls having gas outlet passage means extending therethrough, a valve unit carried on said one wall and in communication with the gas outlet passage means therein, and a covering member disposed over said valve unit and connected with said one wall, said covering member having at least one opening therein with said valve unit being operable to allow gas flow from the interior of said package through said passage means and outwardly through said covering member opening, said valve unit including a porous element impregnated with a relatively low volatility chemically stable liquid insensitive to oxygen, to provide a gas flow blocking layer of said liquid in the pores of said element, said porous element being in sealed fixed relationship around the periphery thereof with said package one wall and said covering member such that gas outflow from the gas outlet passage means through said opening can only occur through said porous element and not around it, the liquid having sufficiently high cohesivity or high surface tension and the porous element having sufficient pore size such that the presence of gas pressure in said container in excess of a predetermined value ruptures the liquid layer in the pores of said element whereby gas outflow occurs through said element, with the liquid layer in said pores restoring when the gas pressure in said container reduces to at least said predetermined value.

2. The package of claim 1 in which the valve unit is disposed at the outer surface of said package one wall.

3. The package of claim 1 in which the valve unit is disposed at the inner surface of said package one wall.

4. The package of claim 1 in which said porous element is fixed around the periphery thereof to said package one wall and said covering member by means of adhesive connection.

5. The package of claim 1 in which said porous element, package one wall and covering member are of heat sealably compatible materials, and said porous element is fixed around the periphery thereof to said package one wall and said covering member is a heat-seal connection.

6. The package of claim 1 in which said liquid is selected from the group consisting of silicone oil, olive oil, peanut oil, bone oil, mineral oil and plasticizers.

7. The package of claim 1 in which said liquid has a viscosity of between about 3 and about 12 Engler degrees at 20° C.

8. The package of claim 1 in which said porous element is filter paper.

9. The package of claim 1 in which the valve unit is embodied in a self contained assembly of a porous element impregnated with said liquid, and covering members disposed at each side of said porous element, said covering members having openings therein and being in sealed connection one with the other, said porous element being fixed around the periphery thereof to the inner surfaces of said covering members, one of said covering members being fixed to the package one wall.

10. The package of claim 1 in which said covering member is a shaped component having a recessed cavity therein, said shaped component being fixed to said one wall and having a recessed cavity therein, there being a radially inwardly directed flange at the entrance to said cavity, said porous element being received in said cavity and being in tight engagement around the periphery thereof with said flange at the underside of the said flange.

* * * * *